United States Patent [19]

Klem

[11] 4,349,307

[45] Sep. 14, 1982

[54] STRUCTURE FOR CENTER HINGE AND BOOM CYLINDER PIVOT

[75] Inventor: John E. Klem, Waukegan, Ill.

[73] Assignee: International Harvester Co., Chicago, Ill.

[21] Appl. No.: 249,573

[22] Filed: Mar. 31, 1981

[51] Int. Cl.[3] ..... B66F 9/075

[52] U.S. Cl. ..... 414/686; 280/400; 403/161; 403/379

[58] Field of Search ..... 280/400; 414/685, 686, 414/722; 403/161, 378, 379; 172/272, 273, 292

[56] References Cited

U.S. PATENT DOCUMENTS 2,872,227 2/1959 Wachs ..... 403/379

3,328,049 6/1967 Luterbach ..... 280/400 X

FOREIGN PATENT DOCUMENTS 735563 8/1955 United Kingdom ..... 172/272

*Primary Examiner*—Robert J. Spar

*Assistant Examiner*—Donald W. Underwood

*Attorney, Agent, or Firm*—D. K. Sullivan; F. D. Au Buchon

[57] ABSTRACT

A structure for the lower hinge and boom cylinder pivot of an articulated loader having a tube extending across and secured to the front frame of the loader with stub shafts secured in each end of the tube and protruding therefrom to act as pivotal mountings for the boom cylinders. The lower hinge has upper and lower plates secured to the cross tube to form a box section to provide strength and rigidity.

7 Claims, 6 Drawing Figures

STRUCTURE FOR CENTER HINGE AND BOOM CYLINDER PIVOT

BACKGROUND AND SUMMARY OF THE INVENTION

This invention relates to rubber-tired loaders generally, and more particularly to an improved structure for mounting the boom cylinders and the lower hinge member of an articulated loader.

In the past it has been common practice to provide a reaction mounting for the boom cylinders by securing a tube to the tractor frame and inserting a solid shaft through the tube. The shaft extended beyond the tube on each side of the frame. The boom cylinders were then pivotally mounted on the protruding ends of the shaft. The centilevered ends of the shaft were subjected to high bending loads as a result of the reaction force created by hydraulic pressure in these cylinders. The bending loads are sometimes sufficiently high to cause plastic deformation in the shaft. When this occurs, extracting the shaft from the tube for repair is very difficult, often necessitating cutting both the tube and the shaft, such as with a burning torch, near the middle in order to effect removal of the shaft, thereby creating a need to reconstruct the tube to accommodate a new shaft.

In addition, the support structure for the lower hinge, when the loader is of the articulated type, has to be strong. The lower hinge must react loadings at various angles of the frame, while also reacting some of the forces due to turning as steering cylinders on each side of the frame extend and retract to articulate the loader. Since the loads were high and imposed from any one or several of a multitude of directions, the prior art structure mounting the lower hinge was heavy and expensive.

It is, therefore, an object of this invention to provide a support for the lower hinge which will be capable of resisting the various loads imposed thereon, and which is relatively light weight and inexpensive.

It is another object of this invention to provide such a support which possesses adequate strength and rigidity, and which cooperates with the boom cylinder support tube to provide a light weight and efficient structure for mounting both the lower hinge and the boom cylinders.

It is also an object of this invention to provide a boom cylinder support which will permit repair with relative ease and speed, which is relatively inexpensive to manufacture and maintain, and which will allow repair of one of the two boom cylinder pivotal mountings independent of the other.

It is a further object of this invention to provide such a boom cylinder support which cooperates with, and forms a part of the lower hinge support so that each support contributes to the strength and rigidity of the other.

These and other objects of the present invention, and many of the attendent advantages thereof, will become more readily apparent upon a perusal of the following description and the accompanying drawings, wherein.

DESCRIPTION OF A PREFERRED EMBODIMENT

Figure 1:
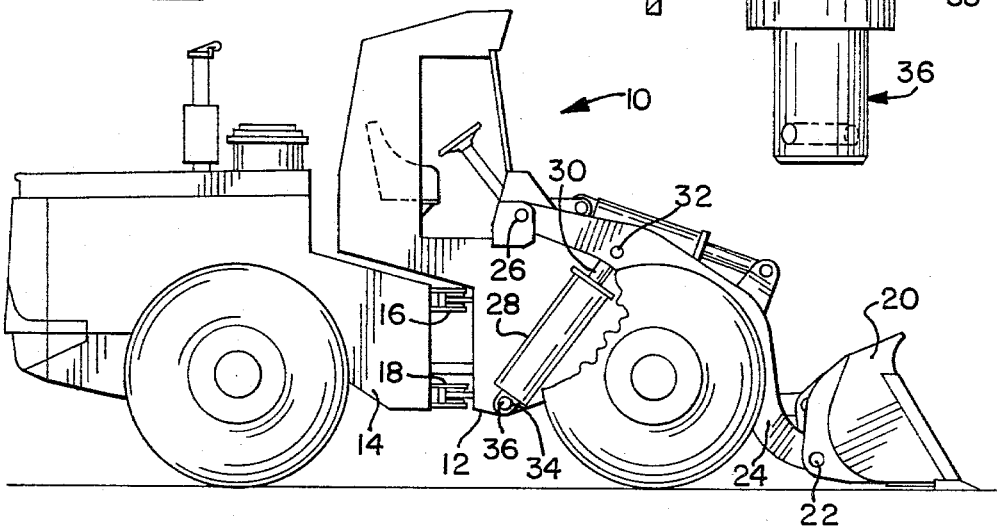
FIG. 1 is a side elevational view of an articulated loader incorporating the present invention.
Figure 2:
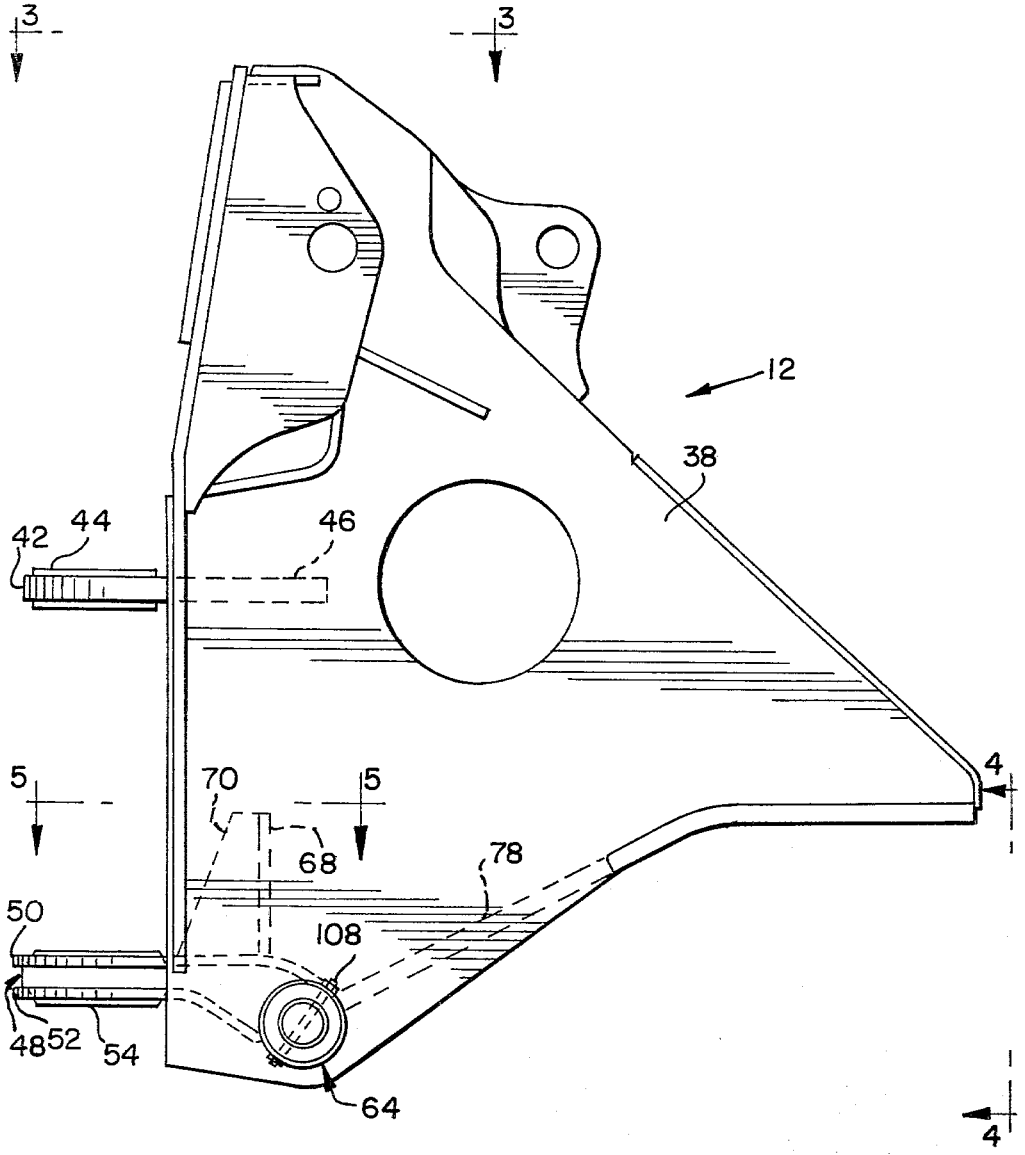
FIG. 2 is a side elevational view of the front frame of the articulated loader of FIG. 1.

Referring now to FIG. 1, there is shown an articulated loader, indicated generally at 10, having a front frame 12 and a rear frame 14 which are pivotally interconnected by an upper hinge 16 and a lower hinge 18. A loader bucket 20 is pivotally attached by pins 22 to the free ends of a pair of boom arms, one of which is shown at 24. The boom arms are pivotally mounted by pins 26 to the front frame 12 and are raised and lowered by extension and contraction of hydraulic rams 28, each ram having its rod 30 pivotally connected by pin 32 to one of boom arms 24 and its cylinder end 34 pivotally connected by pin 36 to the front frame 12.

Figure 3:
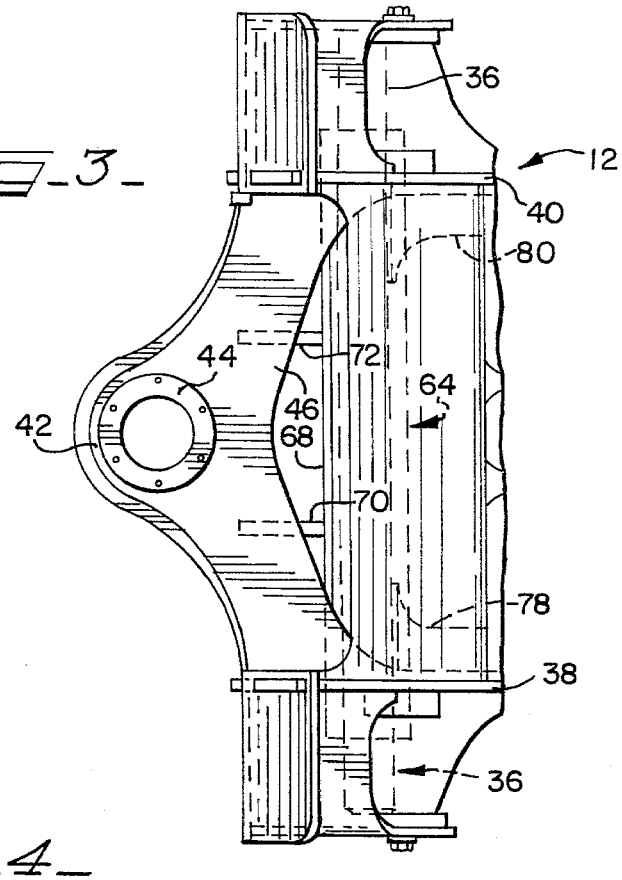
FIG. 3 is a view taken on line 3—3 of FIG. 2.
Figure 4:
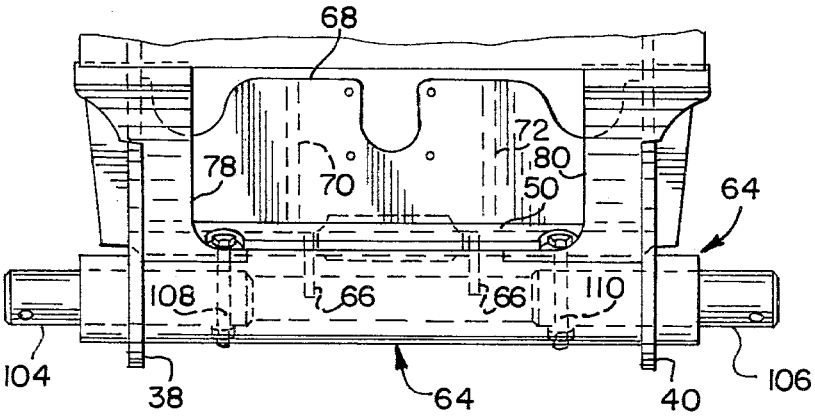
FIG. 4 is a view taken on line 4—4 of FIG. 2.

Referring now to FIGS. 2–6, the front frame 12, includes a pair of side plates 38 and 40. As best seen in FIG. 3, the middle leaf 42 of the upper hinge 16 includes a bearing retained within a plate arch member 46 secured to and spanning the distance between the side plates 38 and 40.

Figure 6:
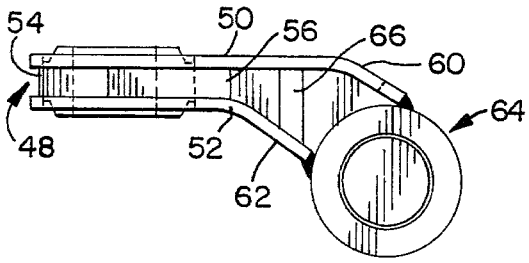
FIG. 6 is a detailed side elevational view of the structure shown in FIG. 5.
Figure 5:
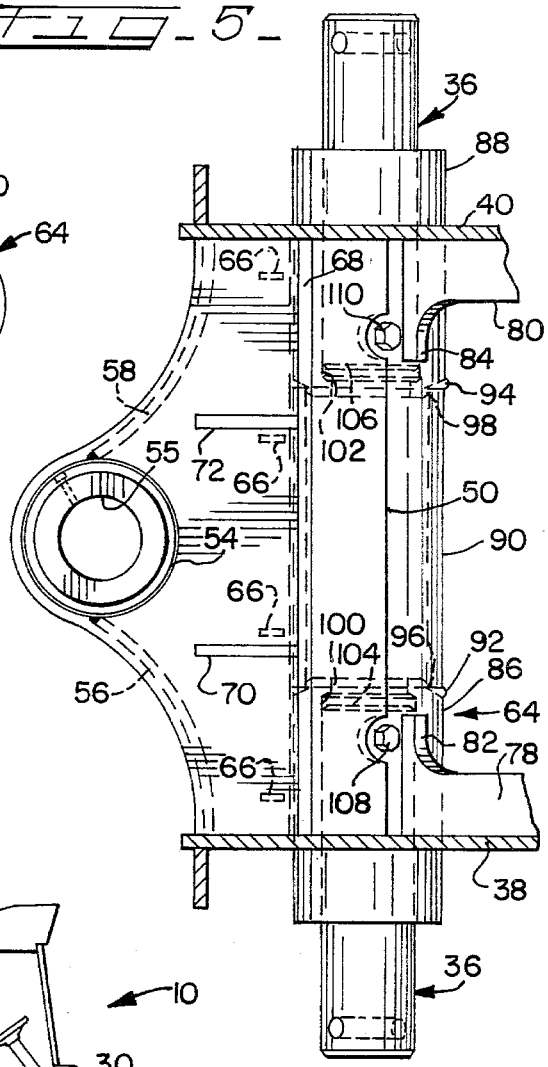
FIG. 5 is a view taken on line 5—5 of FIG. 2.

The middle leaf 48 of the lower hinge 18 comprises an upper plate 50 and a lower plate 52, each of which span the distance between and are secured to the side plates 38 and 40. A bearing hub 54 is positioned between and secured to the plates 50 and 52. The hub 54 has a bore 55 to accept a bearing, which bearing facilitates pivoting of the hinge 18, and hence articulation of the loader 10. The hub 54 also serves to maintain a spacing between the upper and lower plates 50 and 52. A pair of vertical members 56 and 58 are positioned between and secured to the plates 50 and 52. The members 56 and 58 have an arcuate shape, as best seen in FIG. 5, to conform to the arcuate rearward edge of the plates 50 and 52, and are secured at their outer ends to the side plates 38 and 40 respectively and at their inner ends to the hub 54. The forward ends of the plates 50 and 52 are angled downward at 60 and 62 respectfully for contact with and securement to a cross tube 64. The cross tube 64 extends through aligned holes in the side plates 38 and 40 and is secured to these plates. It will be seen that the upper and lower plates 50 and 52, the hub 54, the member 56 and 58, the side plates 38 and 40 and the cross tube 64 form a unitary box section to provide strength and rigidity to the middle leaf 48, and hence, also to the lower hinge 18.

Additional strength and rigidity are provided by stringers 66 secured between the upper and lower plates 50 and 52. Further strength and rigidity is provided by a vertical plate 68 secured between and to the side plates 38 and 40 and along its lower edge to the upper plate 50. A pair of vertical stiffening members 70 and 72 are secured to the rear face of the plate 68 and to the upper surface of plate 50. The side plates 38 and 40 are strengthened, and the stresses induced in the tube 64 by the boom rams 28 are distributed more efficiently to the side plates 38 and 40 by flange members 78 and 80 secured to the inner faces of side plates 38 and 40. The flange members 78 and 80 flare inward at 82 and 84 respectively at their rearward ends for contact with and securement to the cross tube 64.

The cross tube 64 is preferably formed of a pair of outer tubular members 86 and 88 with a central tube 90 secured thereto, such as by welds 92 and 94. The outer diameters of the members 86 and 88 are equal and equal to the outer diameter of the central tube 90. However, the wall thickness of the central tube 90 is not as thick as that of the outer members 86 and 88. A preferred method of constructing the tube 64 is to turn a reduced diameter section as shown at 96 and 98 on the inner end of the outer members 86 and 88. The outer diameter of sections 96 and 98 should be just small enough to accept the inner diameter of the central tube 90. The shoulder formed by the sections 96 and 98 will then locate the outer members relative to the central tube, and preferably will also include a welding groove, for welding the three pieces into a unitary structure. The outer tubular members 86 and 88 previously have been counterbore at 100 and 102 to accept the stub shafts 104 and 106 which shafts are then secured to the outer members 86 and 88 by bolts 108 and 110 which pass through aligned holes in the outer members and the inner ends of the shafts 104 and 106. These bolts insure these shafts will not rotate in the tubes 86 and 88 and will not move axially relative thereto. The stub shafts 104 and 106 accept the cylinder ends 34 of the boom rams 28 and function as the pin 36 pivotally connecting these rams 28 to the frame 12. It can be seen that repair of a defective cylinder end to stub shaft connection can be made independent of the other said connection. Also, it will be appreciated that the removal of one stub shaft can be effected merely by removal of the associated ram and extraction of the associated bolt. In the event the stub shaft should become bent, it can be removed by conventional shaft or stb removal procedures with relative ease and a new stub shaft installed. In order to minimize the stress concentration effect of the holes necessary to accept the bolts 108 and 110, the longitudinal axis of the bolts should be aligned with the longitudinal axis of the rams 28.

While a preferred embodiment of the present invention has been shown and described herein, it is understood that various changes and modifications may be made therein without departing from the spirit of the invention as defined by the scope of the appended claims.

What is claimed:

1. In a loader having a frame with a pair of boom arms pivotally mounted thereon, a pair of boom cylinders pivotally connected to the boom arms for raising and lowering thereof, an improved mounting for pivotal connection of the boom cylinders to the frame comprising:

a tube spanning the width of the frame and secured thereto;

a pair of stub shafts;

a stub shaft positioned in each end of the tube and protruding therefrom;

a bolt passing through the tube and the inner end of each stub shaft to secure the stub shaft in the tube; and the bolt being substantially in alignment with the boom cylinder when fully extended.

2. The invention according to claim 1, wherein said tube comprises:

a pair of tubular end members;

a thin-walled central tubular member having an inner diameter greater than the inner diameter of the end member, the end members having a reduced diameter inner end portion substantially equal to the inner diameter of the central member, the inner end portions being inserted with said central member; and weld means securing the end members to the central members to form a unitary tube.

3. In an articulated loader having front and rear frames pivotally interconnected by upper and lower hinges, a pair of boom arms pivotally mounted on the front frame, and a pair of boom cylinders connected between the front frame and the boom arms; and improved support for the lower hinge on the front frame comprising:

a tube extending across and secured to the front frame;

upper and lower plates secured to the tube;

a bearing hub positioned between and secured to said plates; and vertical members extending from said hub to the front frame and positioned between and secured to said plates to form a box section.

4. The invention according to claim 3, and further comprising:

a pair of stub shafts, one secured in each end of said tube and protruding therefrom to pivotally connect said boom cylinders to said front frame.

5. The invention according to claims 3 or 4, and further comprising:

a plurality of stringers secured between said plates and spaced apart along a line parallel to said tube.

6. The invention according to claim 5, and further comprising:

a vertical plate secured to the upper plate and extending substantially parallel to said tube.

7. The invention according to claim 6, wherein said tube comprises:

a pair of outer tubular members;

a central member having an outer diameter substantially equal to the outer diameter of said outer members, but with a wall thickness less than said outer member, and with means securing said member into a unitary tube.

* * * * *